United States Patent [19]

Edouart

[11] Patent Number: 4,991,994

[45] Date of Patent: Feb. 12, 1991

[54] HIGHWAY TRAFFIC LANE AND EDGE DELINEATOR

[76] Inventor: Robert F. Edouart, 18207 Verano Dr., San Diego, Calif. 92128

[21] Appl. No.: 419,691

[22] Filed: Oct. 11, 1989

[51] Int. Cl.[5] ..... E01F 9/06

[52] U.S. Cl. ..... 404/10; 404/16

[58] Field of Search ..... 404/9, 10, 11, 15, 16

[56] References Cited

U.S. PATENT DOCUMENTS

| | | | |
|---|---|---|---|
| 4,061,435 | 12/1977 | Schmanski et al. | 404/10 |
| 4,521,129 | 6/1985 | Krech et al. | 404/16 |
| 4,534,673 | 8/1985 | May | 404/16 |

FOREIGN PATENT DOCUMENTS

| | | | |
|---|---|---|---|
| 1252512 | 12/1960 | France | 404/15 |

*Primary Examiner*—Ramon S. Britts
*Assistant Examiner*—Terry Lee Melius
*Attorney, Agent, or Firm*—Robert R. Meads

[57] ABSTRACT

A generally L-shaped, single piece resilient polymer-based pavement marker including a horizontally extending base, a vertically extending leg tapering inwardly as it rises from the base with a rear face extending from a lower edge of the base below a top surface thereof and with a forward face facing oncoming highway traffic, and a fillet joining the forward face of the leg and the top surface of the base.

6 Claims, 1 Drawing Sheet

HIGHWAY TRAFFIC LANE AND EDGE DELINEATOR

BACKGROUND

The present invention relates to highway traffic lane and edge delineators and, more particularly, to an improved, inexpensive highway pavement marker which is useful over a wide range of roadway conditions Today, it is common for highway traffic lanes and edges to be delineated by light reflective pavement markers. Such markers may be classified as either permanent or temporary. Permanent pavement markers generally comprise a hard plastic low profile base having inclined front and rear reflective faces. Permanent pavement markers are installed on lines defining traffic lanes and highway edges. Light is reflected from the reflective faces of the permanent pavement markers providing drivers with a clear visual indication of the traffic lanes and edges of the highway on which they are traveling. Although permanent pavement markers are relatively long lived, they are relatively expensive and require periodic maintenance In particular, with repeated striking by the tires of cars and trucks permanent pavement markers often become cracked or dislodged. When a permanent pavement marker becomes dislodged from a highway surface, it often leaves a cavity in the pavement which can result in a rapid erosion of the pavement surrounding the cavity. To prevent such occurrences requires regular monitoring of highway pavement markers and either the prompt replacement of dislodged pavement markers or pavement patching to fill the cavities left by dislodged markers.

Further, when permanent pavement markers are installed on highways in areas subject to snow conditions, they are regularly damaged and dislodged during normal snowplow operations. This has become such a serious problem in areas subject to heavy snows that either permanent pavement markers are not installed or specially designed protective ramps are installed adjacent the markers. However, such ramps are relatively expensive and have found limited commercial acceptance.

On many occasions, it is desired to delineate highway lanes and edges for relatively short periods of time such as several weeks or a few months. Under such conditions, it is common to utilize relatively inexpensive temporary pavement markers. Specific instances where temporary pavement markers have been utilized include road construction and repair situations where it is desired to temporarily delineate a modification in existing traffic lanes or where a highway is being resurfaced with the addition of an asphalt covering. In road resurfacing situations, temporary pavement markers are mounted along an existing traffic line. Then asphalt is poured over the roadway with the tops of the temporary pavement marker being exposed through the asphalt covering to provide and indication where a new traffic line should be painted.

Temporary pavement markers heretofore have been formed of a very inexpensive light weight plastic such as polyurethane which may be extruded to form single piece pavement markers having a T or L shape. The two most common of such temporary pavement markers are illustrated in FIGS. 1 and 2 of the drawing accompanying this specification.

As illustrated in FIG. 1, the T-shaped temporary pavement marker includes a flat base and a vertical leg extending from the base intermediate the forward and rear edges thereof. A layer of adhesive is fixed to the bottom of the base and covered with a protective paper until it is intended to install the temporary pavement marker. In this regard, installation of the temporary pavement marker illustrated in FIG. 1 simply requires the removal of the paper sheet, the placing of the base on a cleaned surface of the pavement and the application of foot or hand pressure to the top of the base to adhere the marker to the pavement. While it is intended that the marker of FIG. 1 have a useful life of several weeks, in actual practice, it has been found that it is very short lived. For example, after 5 or 6 cycles of tires striking a forward face of the vertical leg when the pavement temperature is about 100 degrees Fahrenheit or after 2 or 3 cycles when the pavement temperature is about 10 degrees Fahrenheit, the vertical leg assumes the inclined position as shown in dotted outline in FIG. 1 After about 20 cycles at a pavement temperature of about 100 degrees Fahrenheit or after about 5 cycles at 10 degrees Fahrenheit, the leg is permanently bent or fractured along its junction with the base to remain in a useless flat condition as illustrated by the broken outline in FIG. 1.

The L-shaped temporary pavement marker illustrated in FIG. 2 fairs no better under actual operating conditions. As illustrated, the L-shaped temporary pavement marker includes a flat base to which adhesive is secured and covered by a sheet of protective paper. A vertical leg is secured to and extends upwardly from the base at a rear edge thereof. At a pavement temperature of about 100 degrees Fahrenheit, 5 or 6 cycles of tires striking the leg will cause the leg to bend to an inclined position as illustrated by the dotted line in FIG. 2 Only 2 or 3 cycles are required when the pavement temperature is about 10 degrees Fahrenheit. After 15 cycles at a pavement temperature of about 100 degrees Fahrenheit or after 5 cycles at 10 degrees Fahrenheit the leg assumes a useless flattened condition or fractures along the junction with the base to remain in a flattened condition as illustrated by the broken outline in FIG. 2. Accordingly, unless such prior temporary pavement markers are installed on highways substantially free of vehicular traffic, their useful life is about less than 1 or 2 weeks. Certainly, such temporary pavement markers are nearly useless under snow conditions where plowing of highways is required.

Therefore, a need exists for a inexpensive pavement marker which will reliably delineate highway traffic lanes and edges over a wide range of pavement temperature conditions such as between −40 and 160 degrees Fahrenheit and which will resist damage and dislodging by vehicle tires and snow plows. The improved highway traffic lane and edge delineator of the present invention satisfies such needs.

SUMMARY OF INVENTION

To overcome the disadvantages and shortcomings of prior permanent and temporary pavement markers, the highway traffic lane and delineator of the present invention comprises a generally L shaped, single piece, resilient polymer-based pavement marker including a horizontally extending base for supporting the marker on a pavement surface. A leg extends in a vertical direction and tapers inwardly as it rises from the base with a rear face of the leg extending from an edge of the base below a top surface thereof and with a forward face of the leg facing oncoming highway traffic when the marker is secured on the pavement surface. The leg and base are joined by a fillet which provides a relatively thick concave junction between the forward face of the leg and the top surface of the base. Preferably, the Pavement marker is constructed to assume an initial condition wherein the leg extends upwardly from the base at a slight forward angle from vertical to face oncoming traffic and upon compaction of the marker with repeated striking of the marker by such highway traffic thereafter assumes a substantially vertical condition. To provide improved locking of the marker to the pavement surface, the bottom of the base includes a plurality of separate transverse channels for securely holding a pavement gripping adhesive for securing the marker to the pavement surface. Further the marker is preferably formed of a polymer base material resilient over a temperature range of about −40 to 160 degrees Fahrenheit.

Thus constructed, after the pavement marker is locked on the pavement surface by application of hand or foot pressure to the pavement adhesive by a pressing on the top of the base, the forwardly incline leg upon being struck by a tire of an oncoming vehicle will fold back to a flat condition. Then, after the tire has passed over the marker, (1) the vertically and inwardly tapering structure of the leg (2), concave structure of the fillet connection of the leg to the base and junction of the rear face of the leg below the top of the base combine to effectively define a spring loaded hinge which causes the resilient leg to return to near its initial upright condition. Repeated striking of the vertical leg by the tires of oncoming traffic produces a compacting and stretching of the marker material which in practice has resulted in a saturation or compaction thereof with the vertical leg extending upwardly from the base at substantially a 90 degree angle to the base. Once such compaction has occurred, the leg continues to return to its vertical condition for nearly an unlimited number of cycles over temperature conditions ranging from about −40 to nearly 160 degrees Fahrenheit. Since the improved pavement marker of the present invention functions reliably at very low and very high temperatures it is ideal for use on desert highways as well as in geographical areas subject to snow conditions with regard to the latter, the structure of the improved pavement marker is such that when the base of the marker is secured in a shallow trench in the pavement surface, the marker will flatten upon contact by a snowplow blade and remain secured to the pavement surface while the snowplow blade passes thereover, and then return to its vertical condition to continue to provide the desired highway traffic lane and edge delineation functions.

DETAILED DESCRIPTION OF INVENTION

Figure 1:
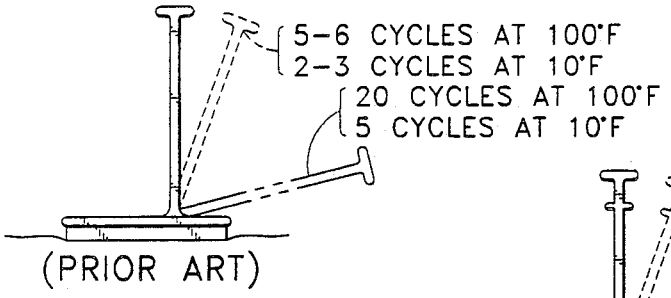
FIG. 1 is a side view of a prior art T-shaped temporary pavement marker.
Figure 2:
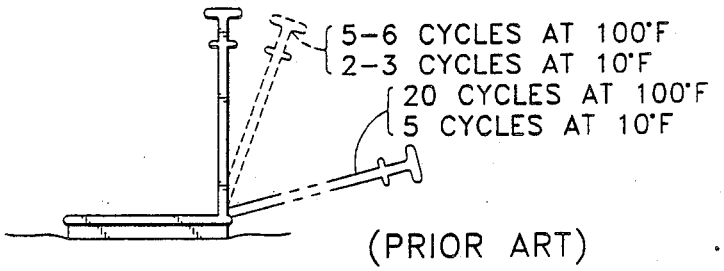
FIG. 2 is a side view of an L-shaped temporary pavement marker.
Figure 4:
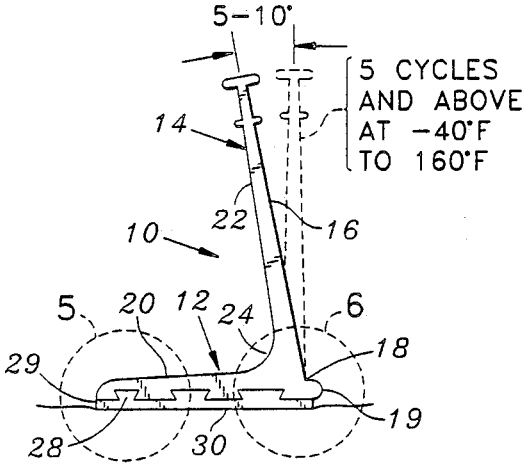
FIG. 4 is a side view of the delineator illustrated in FIG. 3.
Figure 3:
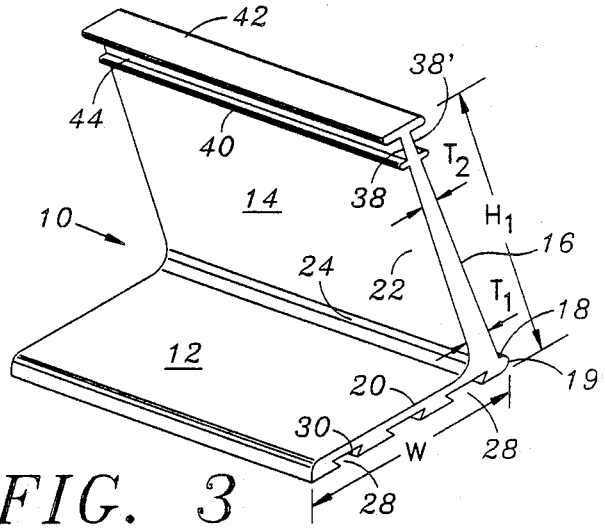
FIG. 3 is a perspective view of a preferred form of the improved traffic lane and edge delineator of the present invention.

As illustrated most clearly in FIGS. 3 and 4, the improved highway traffic lane and edge delineator of the present invention comprises a pavement marker indicated generally by the numeral 10 having an L shape and formed in a single piece of resilient polymer-based material. The pavement marker includes a horizontally extending base 12 for supporting the marker on a pavement surface. A leg 14 extends in a vertical direction and tapers inwardly as it rises from the base 12. A rear face 16 of the leg 14 extends from a lower edge 18 of the base 12 along a rearwardly extending stabilizing foot 19 below a top surface 20 of the base. A forward face 22 of the leg 14 faces oncoming highway traffic when the marker 10 is secured on the pavement surface and is joined to the top surface 20 of the base 12 by a fillet 24.

Preferably, the fillet 24 has a radius of curvature R greater than the thickness of the leg 14 at its junction with the fillet. The thickness of the leg 14 at the junction with a fillet 24 is illustrated in FIG. 3 as T1 and by way of example may be 0.175 inches while the radius of curvature R may be 0.25 inches.

Figure 5:
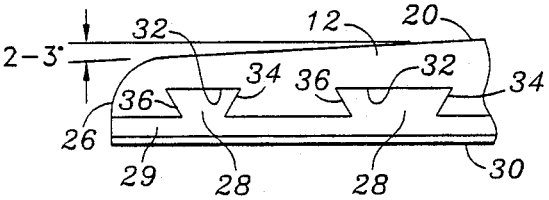
FIG. 5 is an enlarged view of a forward edge portion of the base of the delineator of the present invention as indicated by the circle 5—5 in FIG. 4.
Figure 6:
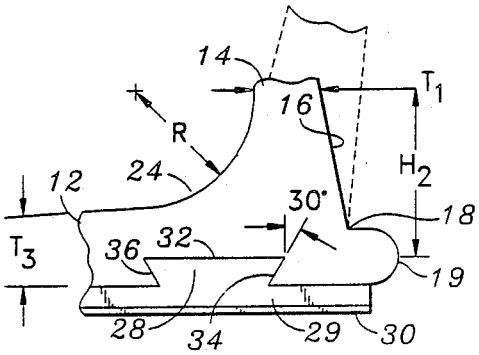
FIG. 6 is an enlarged fragmentary side view of a rear portion of the base and leg comprising the delineator of the present invention and depicted within the circle 6—6 in FIG. 4.

As previously indicated, the leg 14 tapers inwardly as it rises vertically from the rear edge 18 of the base 12. More specifically, as illustrated in FIG. 3, the height of the marker 10 is indicated by H1 and may be about 2.5 inches while the thickness of the leg 14 may 0 taper from a dimension T1 of about 0.175 inches to a dimension T2 of about 1 inches As illustrated in FIG. 6, the height at which the thickness T1 is measured is designated by H2 and may be about 0.5 inches while as illustrated in FIG. 3, the width of the pavement marker 10 including the base 12 is designated by W and may be about 1.625 inches. As also illustrated in FIG. 6, the thickness of the base 12 at its junction with the fillet 24 is designated by T3 and may be about 0.165 inches. And as illustrated in FIG. 5, the top surface 20 of the base 12 is tapered upwardly from a forward edge 26 of the base to its junction with the fillet 24 at an angle of between 2 and 3 degrees.

Preferably, the leg 14 is initially inclined slightly in a forward direction from vertical In fact, as illustrated in FIG. 4, in an initial condition for the marker 10 before installation on a pavement surface, the leg 14 extends upwardly from the base 12 at a forward angle of about 5 to 10 degrees from vertical to face oncoming highway traffic. Then, upon compaction of the marker 10 with repeated striking of the marker by such highway traffic, the leg 12 assumes a substantially vertical condition as illustrated by the dotted outline of the leg 14 in FIG. 4. More particularly, as the marker 10 is repeatedly struck by the tires of oncoming vehicles, the tires roll over the base 12 and cause the leg 14 to lay back on the top surface of the pavement. As this occurs, the fillet 24 is stretched and the rear face 16 of the leg 14 adjacent the lower edge 18 and along the foot 19 is compressed to in effect define a spring loaded hinge for automatically returning the leg 14 to a vertical condition after the tire passes over the marker. Further, as the stretching and compression action repeatedly occurs, the materials forming the marker 10 in the region of the fillet where the leg 14 is widest, tends to saturate or compact. The result of such compaction is that the leg 14 assumes a near vertical condition as illustrated in FIG. 4 by the broken outline of the leg. The semi-vertical posture for the leg 14 in a rest condition remains permanent irrespective of continued tire or roadway abuse. Thus upon each additional cycle of a tire rolling over the marker 10, the leg 14 returns to its semi-vertical condition.

As previously indicated, the base 12 comprises the means for supporting the marker 10 on a pavement surface. In that regard, in order to securely adhere the marker to the pavement surface, the bottom of the base 12 preferably includes a plurality of separate transverse channels 28 for securely holding a pavement gripping adhesive 29, such as epoxy, a synthetic polymer, a buytal lastic or an asphalt adhesive. The pavement gripping adhesive 29 is formed as a layer on the bottom of the base 12 with portions gripped tightly within the channels 28. To prevent the adhesive from sticking to surfaces before the marker is ready for installation, the bottom surface of the adhesive 29 is covered by a sheet of paper like material 30.

Preferably, each transverse bottom channel 28 includes a top surface 32 and opposing sides 34 and 36 extending inwardly from the top surface 32. In particular, the sides 34 and 36 preferably extend inwardly at about 30 degree angles from vertical. Such a configuration of bottom channels in the base and adhesive layer 29 form a combination which maximizes the gripping action between the base 12 and the adhesive 29 and between the base 12 and the surface of the pavement upon which the marker 10 is installed. In this regard to install the pavement marker 10, one simply peals off the paper 30 to expose the adhesive 29 and places the marker on the pavement surface. Then by applying either hand or foot pressure to the top surface 20 of the base, the adhesive 29 firmly grips the pavement surface to tightly bond the marker 10 thereto.

With the marker 10 thus secured to the pavement surface, the leg 14 functions to support light reflective means in the direction of oncoming traffic or in the direction of both oncoming and rearwardly coming traffic. To accomplish this, and as illustrated most clearly in FIG. 3, the upper portion of the forward face 22 of the leg 14 includes a horizontally extending channel 38. A similar channel 38' is located opposite the channel 38 on the rear face 16 of the leg 14. Preferably such channels are defined by vertically spaced horizontal ribs 40 and 42. Strips of light reflective material 44 are located between the ribs 40 and 42 to lie along the base of the channels 38 and 38' and function to reflect light from oncoming and rearwardly coming vehicles to provide a visual indication of a traffic lane or edge where the marker 10 is located. Being housed within the channels 38 and 38', the reflective strips 44 are protected by the ribs 40 and 42 from contact by the tires of oncoming vehicles striking the forward face 22 or the rear face 16 of the leg 14. Further, the ribs 40 and 42 maintain the position of the reflective strips 44 as a tire rolls over the marker to cause the leg 14 to bend to a flattened position.

As previously indicated, the material forming the pavement marker is a resilient polymer based material For example, the material may be a thermal plastic elastomer, an ethylene propylene material or a rubber-based polymer. Preferably, the material comprising the marker 10 is ELAST-O-LENE, a material manufactured by Kirkhill Rubber of Brea, Calif. Such materials possess the important characteristic of being resilient over a wide temperature range of about −40 to 160 degrees Fahrenheit. Being formed of such materials, the marker 10 will reliably function as described both on the hottest desert floor and in high mountains under snow and ice conditions. In particular, the tapered and curved structure of the base and leg portions of the marker 10 as well as the bending characteristics of the leg about the rear edge 18 allows for use of the pavement marker in snow conditions subject to snow plowing. In such situations, when the base 12 of the marker is secured in a shallow trench in the top surface of the pavement, the blade of a snowplow will ride over the forward edge 26 and top surface 20 of the base Upon engaging the fillet 24, the leg 14 bends to its flattened condition allowing the snowplow blade to pass thereover without permanently damaging the marker or causing it to dislodge from the pavement.

Accordingly, the highway traffic lane and edge delineator to the present invention overcomes the shortcomings associated with both permanent as well as temporary pavement markers by providing a very inexpensive yet extremely sturdy and durable marker which is useful over an extremely wide temperature range under high heat and freezing ground conditions.

While a particular embodiment of the improved highway traffic lane and edge delineator has been illustrated and described herein, changes and modifications may be made in the illustrated marker without departing from the spirit of the present invention. Accordingly, the present invention is to be limited in scope only by the terms of the following claims.

I claim:

1. A highway traffic lane and edge delineator, comprising:

a generally L-shaped, single piece, resilient polymer-based pavement marker including a horizontally extending base for supporting the marker on a pavement surface, a leg extending in a vertical direction and tapering inwardly as it rises vertically from the base with a rear face of the leg extending from a lower edge of the base below a top surface thereof and a forward face of the leg facing oncoming highway traffic when the marker is secured on the pavement surface, and fillet means joining the forward face of the leg and the top surface of the base, said fillet means having a radius of curvature which allows for (1) stretching as a tire of an oncoming vehicle rolls over the marker and (2) the leg to fold back from the base in the direction of oncoming traffic and compress in a region of the rear face and the lower edge of the base, whereby as the tire passes over the marker the leg automatically returns to a vertical condition.

2. The delineator of claim 1 where in an initial condition for the marker the leg extends upwardly from the base at a slight forward angle from vertical to face oncoming highway traffic and upon compaction of the marker with repeated striking of the marker by such highway traffic thereafter assumes a substantially vertical condition.

3. The delineator of claim 2 wherein the forward angle is about 5 to 10 degrees from vertical.

4. The delineator of claim 1 wherein the base includes a stabilizing bottom foot extending rearwardly therefrom along the lower rear edge and below the top surface of the base.

5. The delineator of claim 1 wherein said radius of curvature is greater than a thickness of the leg at a junction therewith.

6. The delineator of claim 1 wherein a bottom of the base includes a plurality of separate transverse bottom channels for securely holding a pavement gripping adhesive transverse to oncoming traffic for securing the marker to the pavement surface.

* * * * *